US010976695B2

(12) United States Patent
Tanaka et al.

(10) Patent No.: US 10,976,695 B2
(45) Date of Patent: Apr. 13, 2021

(54) IMAGE HEATING APPARATUS HAVING A POSITIONING PORTION THAT POSITIONS A HEATER HOLDER IN A LONGITUDINAL DIRECTION

(71) Applicant: CANON KABUSHIKI KAISHA, Tokyo (JP)

(72) Inventors: Noriaki Tanaka, Suntou-gun (JP); Yoshinori Hashimoto, Sagamihara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/806,502

(22) Filed: Mar. 2, 2020

(65) Prior Publication Data

US 2020/0201242 A1 Jun. 25, 2020

Related U.S. Application Data

(62) Division of application No. 16/523,556, filed on Jul. 26, 2019, now Pat. No. 10,613,473, which is a (Continued)

(30) Foreign Application Priority Data

May 7, 2015 (JP) ..... 2015-094742
Mar. 15, 2016 (JP) ..... 2016-050770

(51) Int. Cl.
*G03G 15/20* (2006.01)
*G03G 21/16* (2006.01)

(52) U.S. Cl.
CPC ..... *G03G 21/1685* (2013.01); *G03G 15/2017* (2013.01); *G03G 21/1647* (2013.01); *G03G 2215/2035* (2013.01)

(58) Field of Classification Search
CPC ..... G03G 21/1685; G03G 21/1647; G03G 15/2017; G03G 2215/2035
See application file for complete search history.

(56) References Cited

U.S. PATENT DOCUMENTS 8,170,458 B2 5/2012 Nakahara et al.
8,515,326 B2 8/2013 Nakahara et al.
(Continued)

FOREIGN PATENT DOCUMENTS

JP 2001-356623 A 12/2001
JP 2006-350002 A 12/2006
(Continued)

OTHER PUBLICATIONS

Office Action dated Jan. 4, 2019, issued in Chinese Patent Application No. 201610282827.5.
(Continued)

*Primary Examiner* — Clayton E. LaBalle
*Assistant Examiner* — Michael A Harrison
(74) *Attorney, Agent, or Firm* — Venable LLP

(57) ABSTRACT

An image heating apparatus includes a frame having first and second side plates. A cylindrical film is provided between the side plates, and a heater contacts an inner surface of the film. A roller forms a nip in cooperation with the heater through the film, and an image, formed on a recording material, is heated by heat of the heater, while moving in the nip. A holder holds the heater, and is provided in an inside space of the film. With respect to a longitudinal direction, a length of the holder is greater than a distance between the side plates. In addition, a stay, formed of metal, reinforces the holder, and is provided in the inside space of the film. A length of the stay is greater than the distance between the side plates, and a position of the stay with respect to the longitudinal direction is determined by the holder.

12 Claims, 12 Drawing Sheets

Related U.S. Application Data division of application No. 15/983,778, filed on May 18, 2018, now Pat. No. 10,401,780, which is a division of application No. 15/139,654, filed on Apr. 27, 2016, now Pat. No. 10,001,746.

(56) References Cited

U.S. PATENT DOCUMENTS

| | | | |
|---|---|---|---|
| 8,891,989 | B2 | 11/2014 | Umeda et al. |
| 9,329,542 | B2 | 5/2016 | Arai et al. |
| 9,342,010 | B2 | 5/2016 | Shimura et al. |
| 9,395,685 | B2 | 7/2016 | Matsuno |
| 9,429,889 | B2 | 8/2016 | Fujiwara et al. |
| 9,513,583 | B2 | 12/2016 | Ohta et al. |
| 10,001,746 | B2 | 6/2018 | Tanaka et al. |
| 2003/0077092 | A1 | 4/2003 | Ogawa et al. |
| 2010/0028062 | A1 | 2/2010 | Nakahara et al. |
| 2012/0183336 | A1 | 7/2012 | Nakahara et al. |
| 2015/0037078 | A1 | 2/2015 | Ohta et al. |
| 2015/0093159 | A1 | 4/2015 | Matsuno |
| 2015/0139706 | A1 | 5/2015 | Fujiwara et al. |
| 2015/0139708 | A1 | 5/2015 | Shimura et al. |
| 2016/0327900 | A1 | 11/2016 | Tanaka et al. |
| 2017/0371283 | A1* | 12/2017 | Fujita ..... G03G 15/2042 |

FOREIGN PATENT DOCUMENTS

| | | | |
|---|---|---|---|
| JP | 2010-038956 | A | 2/2010 |
| JP | 2010-181822 | A | 8/2010 |
| JP | 2012-047868 | A | 3/2012 |
| JP | 2012-198475 | A | 10/2012 |
| JP | 5388498 | B2 | 1/2014 |
| JP | 2015-068907 | A | 4/2015 |
| JP | 2015-075525 | A | 4/2015 |

OTHER PUBLICATIONS

Office Action dated Oct. 16, 2018, issued in Japanese Patent Application No. 2016-050770.

Office Action dated Jul. 24, 2018, issued in Japanese Patent Application No. 2016-050770.

* cited by examiner

IMAGE HEATING APPARATUS HAVING A POSITIONING PORTION THAT POSITIONS A HEATER HOLDER IN A LONGITUDINAL DIRECTION

This application is a divisional application of copending U.S. patent application Ser. No. 16/523,556, filed Jul. 26, 2019, which is a divisional application of U.S. patent application Ser. No. 15/983,778, filed May 18, 2018, which issued as U.S. Pat. No. 10,401,780, on Sep. 3, 2019, which is a divisional application of U.S. patent application Ser. No. 15/139,654, filed Apr. 27, 2016, which issued as U.S. Pat. No. 10,001,746, on Jun. 19, 2018, and which claims the benefit of Japanese Patent Application No. 2015-094742, filed May 7, 2015, and Japanese Patent Application No. 2016-050770, filed Mar. 15, 2016, which are hereby incorporated by reference herein in their entireties.

FIELD OF THE INVENTION AND RELATED ART

The present invention relates to an image heating apparatus suited for use as a fixing device (film apparatus) mounted in an image forming apparatus, such as a copying machine or a printer, of an electrophotographic type.

As the fixing device mounted in the electrophotographic copying machine or printer, a fixing device of a film type has been known. The fixing device of this type includes a heater in which a heat generating element, which generates heat by energization, is formed along a longitudinal direction of a ceramic substrate, and a pressing roller for forming a nip via a film in cooperation with the heater. A recording material, carrying an unfixed toner image, is heated while being nipped and fed at the nip of the fixing device, so that the toner image is fixed on the recording material.

The fixing device using the film has such an advantage that a time required from start of energization to the heater until a film temperature increases up to a fixable temperature is short. Accordingly, the printer in which the fixing device is mounted can shorten a time (i.e., a first print out time (FPOT)) from after a print instruction (command) is input until an image on a first sheet is output. The fixing device of this type has also such an advantage that electrical power consumption during stand by waiting for the print instruction. The fixing device has the advantages as described above, and, therefore, has been introduced into a high speed image forming apparatus in recent years. For that reason, for the purpose of further improving heat conduction efficiency, a technique to optimize a heater position has been devised.

Japanese Patent No. 5388498 discloses a fixing device in which the heater position is optimized by positioning a heater holder for holding the heater relative to a frame with respect to a feeding direction. The fixing device disclosed in Japanese Patent No. 5388498 is effective for improving the heat conduction efficiency by optimizing positioning of the heater holder with respect to a recording material feeding direction.

In the fixing device using the film, in order to improve the heat conduction efficiency, optimization of positioning of the heater relative to the frame with respect to a longitudinal direction, perpendicular to the recording material feeding direction, is required.

With reference to FIGS. 17 and 18, a positioning structure of a heater holder with respect to a longitudinal direction in a conventional fixing device will be described. FIG. 17 is a front view of the conventional fixing device as seen from a downstream side with respect to a recording material feeding direction (i.e., a direction perpendicular to the drawing sheet surface). FIG. 18 is a front view of a heating unit, from which a film 13 is demounted, as seen from the downstream side with respect to the recording material feeding direction. The positioning structure of the fixing device in an upstream side with respect to the recording material feeding direction is not illustrated, but is the same as that in the downstream side with respect to the recording material feeding direction.

As shown in FIG. 17, left and right frames 19*a* and 19*b* of the fixing device are provided with grooves (not shown). In these grooves, bearings 20*a* and 20*b* are mounted and positioned and hold (i.e., to support) a metal core 17*a* of a pressing roller 17. Flanges 16*a* and 16*b* of a heating unit 18 are mounted in grooves provided in the frames 19*a* and 19*b*, respectively, so as to be vertically slidable. By both of the flanges 16*a* and 16*b*, a position of the film 13 with respect to a longitudinal direction (i.e., an X axis direction) of the fixing device perpendicular to the recording material feeding direction (i.e., a Y axis direction) is regulated. A position of a heater holder 15 with respect to the recording material feeding direction (i.e., the Y axis direction) is determined by abutment of positioning portions 25*a* and 25*b* against rim portions (not shown) of the frames 19*a* and 19*b* constituting the grooves of the frames 19*a* and 19*b*. A gear 21 mounted to a metal core 17*a* of the pressing roller 17 is rotated by power of an unshown motor, so that the pressing roller 17 is rotated. The film 13, contacting the pressing roller 17, is rotated by rotation of the pressing roller 17.

As shown in FIG. 18, the flanges 16*a* and 16*b* receive an urging (pressing) force of urging (pressing) springs 30*a* and 30*b* via pressing plates 32*a* and 32*b*, respectively. The urging force received by the flanges 16*a* and 16*b* is received by the heater holder 15 and is transmitted to a heater 14.

Then, a position of a stay 27 of the fixing device with respect to a longitudinal direction X will be described. The stay 27 is provided between the flanges 16*a* and 16*b*. There is a gap between the stay 27 and the flanges 16*a* and 16*b* with respect to the longitudinal direction X, but the position of the stay 27 is roughly determined by abutment of abutment portions 37*a* and 37*b*, provided on the stay 27, against the flanges 16*a* and 16*b*, respectively. As described above, between the flanges 16*a* and 16*b* and the abutment portions 37*a* and 37*b*, a gap, determined in consideration of a dimensional tolerance and thermal expansion of components (parts), is provided. Between the abutment portions 37*a* and 37*b*, a dimension is relatively large (200 mm or more in the printer using A4 sized paper and Letter sized paper), and, therefore, the above gap is relatively large.

Next, a position of the heater holder 15 of the fixing device with respect to the longitudinal direction X will be described. As shown in FIG. 18, the heater holder 15 is provided with abutment portions 34*a* and 34*b*. The position of the heater holder 15 is roughly determined by abutment of the abutment portions 34*a* and 34*b* of the heater holder 15 against the stay 27. Between the stay 27 and the abutment portions 34*a* and 34*b*, a gap, determined in consideration of a dimensional tolerance and thermal expansion of components (parts), is provided. Between the abutment portions 34*a*, 34*b*, a dimension is relatively large (200 mm or more in the printer using A4 sized paper and Letter sized paper), and, therefore, the above gap is relatively large.

Next, a position of the heater 14 will be described. With respect to the longitudinal direction X, one end of the heater 14 abuts against an abutment portion 29 provided on the heater holder 15, whereby the position of the heater 14 with respect to the longitudinal direction X is roughly determined.

As described above, with respect to the longitudinal direction X of the fixing device, the position of the heater 14 relative to the frames 19*a* and 19*b* is roughly determined by the flanges 16*a* and 16*b*, the stay 27, and the heater holder 15. As described above, however, the gaps determined in consideration of the dimensional tolerances and thermal expansion of the respective components exist, and, therefore, play corresponding to the gaps causes a variation in position of the heater 14 with respect to the longitudinal direction X. The position of the heater 14 with respect to the longitudinal direction X varies for every individual printer. Even when there is an individual variation as described above, in order to properly heat the film irrespective of the individual printer, there is a need to take such a countermeasure that a target control temperature of the heater is set at a high level for all of the printers. By such a countermeasure, however, energy consumption of the fixing device increases, leaving room for improvement.

SUMMARY OF THE INVENTION

A principal object of the present invention is to provide an image heating apparatus excellent in positional accuracy of a heater relative to a frame.

According to one aspect, the present invention provides an image heating apparatus comprising a frame including a first side plate provided at one end portion and a second side plate provided at the other end portion with respect to a longitudinal direction of the image heating apparatus, a cylindrical rotatable member provided between the first and second side plates, a heater contacting an inner surface of the rotatable member, a holder for holding the heater, wherein the holder is provided in an inside space of the rotatable member and with respect to the longitudinal direction, a length of the holder is greater than a distance between the first and second side plates, a first preventing member, contactable to one end surface of the rotatable member when the rotatable member moves toward the first side plate, for preventing movement of the rotatable member in the longitudinal direction, and a second preventing member, contactable to the other end surface of the rotatable member when the rotatable member moves toward the second side plate, for preventing the movement of the rotatable member in the longitudinal direction, wherein an image formed on a recording material is heated by heat of the heater while moving in a state in which the recording material contacts the rotatable member, wherein the holder is unintegral with the first and second preventing members, and wherein the holder includes a positioning portion, contacting the first side plate, for positioning a position of the holder with respect to the longitudinal direction.

Further features of the present invention will become apparent from the following description of exemplary embodiments with reference to the attached drawings.

DESCRIPTION OF THE EMBODIMENTS

In the following, embodiments of the present invention will be described with reference to the drawings. The following embodiments are an example of preferred embodiments of the present invention, but the present invention is not limited to the following embodiments. It is possible to replace various constitutions with other constitutions within the scope of the concept of the present invention.

Embodiment 1

(1) Image Forming Apparatus

Figure 16:
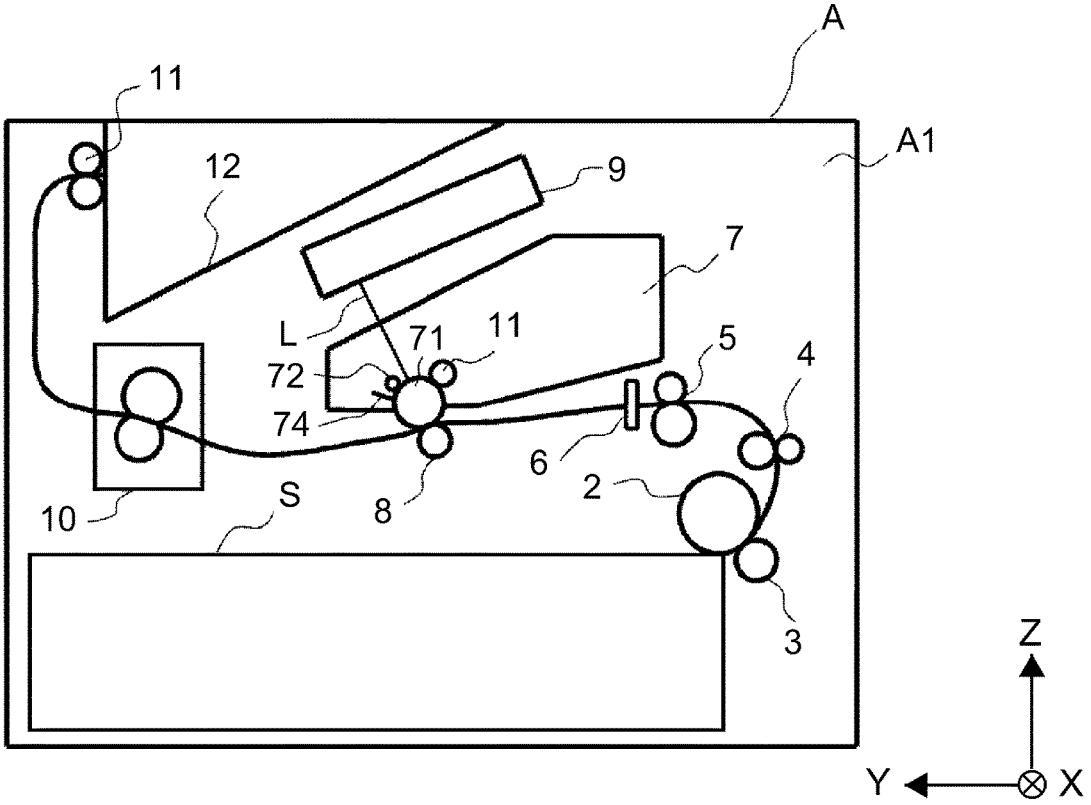
FIG. 16 is a sectional view of an image forming apparatus.
Figure 17:
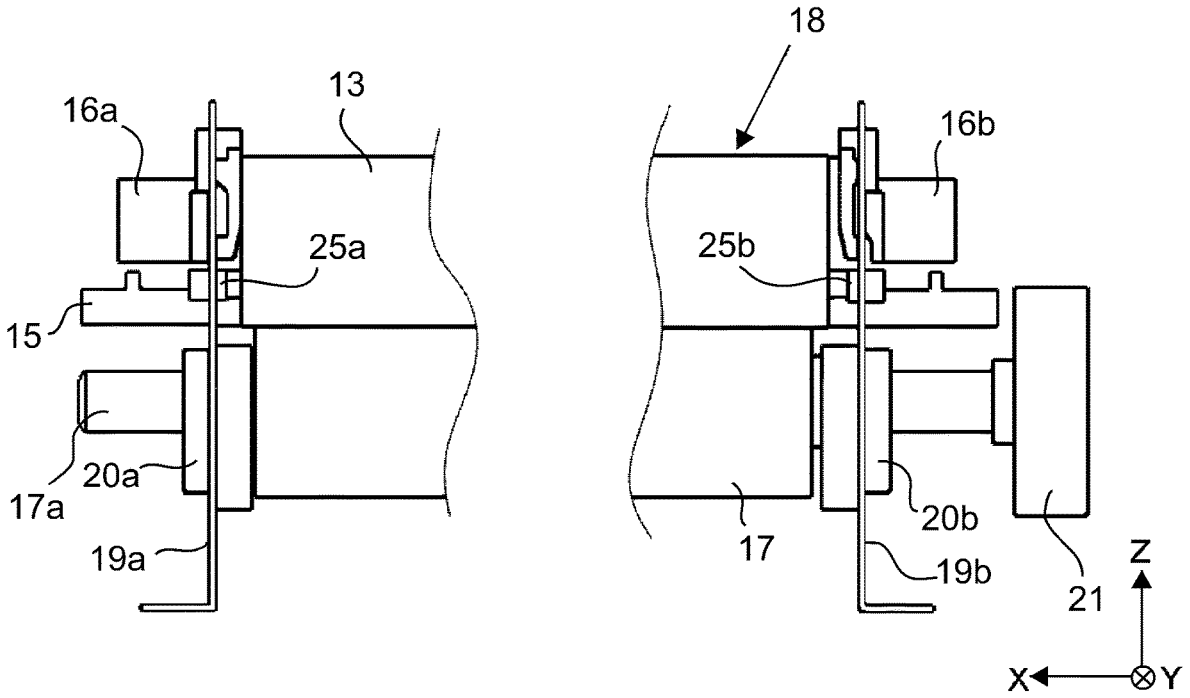
FIG. 17 is a front view of a conventional fixing device.
Figure 18:
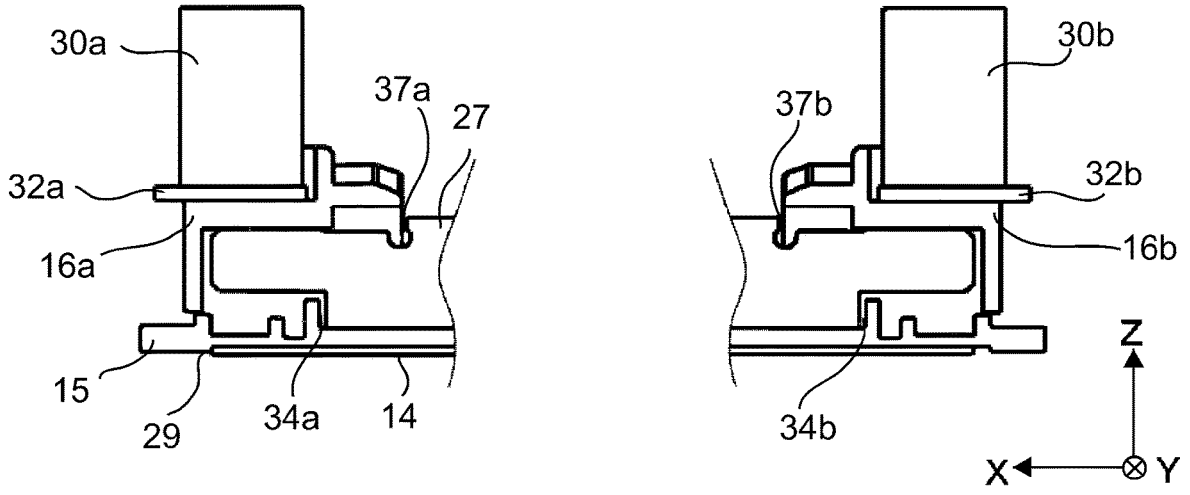
FIG. 18 is a front view of a conventional heating unit.

With reference to FIG. 16, an image forming apparatus in which an image heating apparatus according to the present invention is mounted as a fixing device will be described. FIG. 16 is a sectional view showing a schematic structure of an example of an image forming apparatus (i.e., a monochromatic laser printer in this embodiment) A using an electrophotographic recording technology.

The image forming apparatus A in this embodiment forms an image on a recording material S, as a material to be heated, in a state in which a process cartridge 7 is detachably mounted in an apparatus main assembly A1 of the image forming apparatus A. Here, the process cartridge 7 integrally includes a photosensitive drum 71, a charging member 72, a developing device 73, and a cleaner 74. A process of image formation by this process cartridge 7 is well known, and, therefore, a detailed description, beyond that provided below, will be omitted.

In the following description, the image formation on the recording material S will be described. The recording material S, stacked in a cassette 1, is separated and fed by rollers 2, 3, and then is conveyed to a roller pair 4. Then, the roller pair 4 feeds the recording material S to a roller pair 5. Then, the recording material S passes through a sensor 6 and is fed to a nip between the photosensitive drum 71 and a transfer roller 8.

On the other hand, a laser scanner 9 irradiates the photosensitive drum 71 with laser light L in synchronism with timing of leading end detection of the recording material S by the sensor 6, so that a toner image is formed on the surface of the photosensitive drum 71 by a process in the process cartridge 7. The toner image is transferred onto the recording material S nipped between the photosensitive drum 71 and the transfer roller 8. The recording material S, on which the toner image is transferred, is fed to a film device 10, and the toner image is fixed on the recording material S by the film device 10. The recording material S, on which the toner image is fixed, is discharged onto a tray 12 by a roller pair 11.

(2) Fixing Device 10

Figure 1:
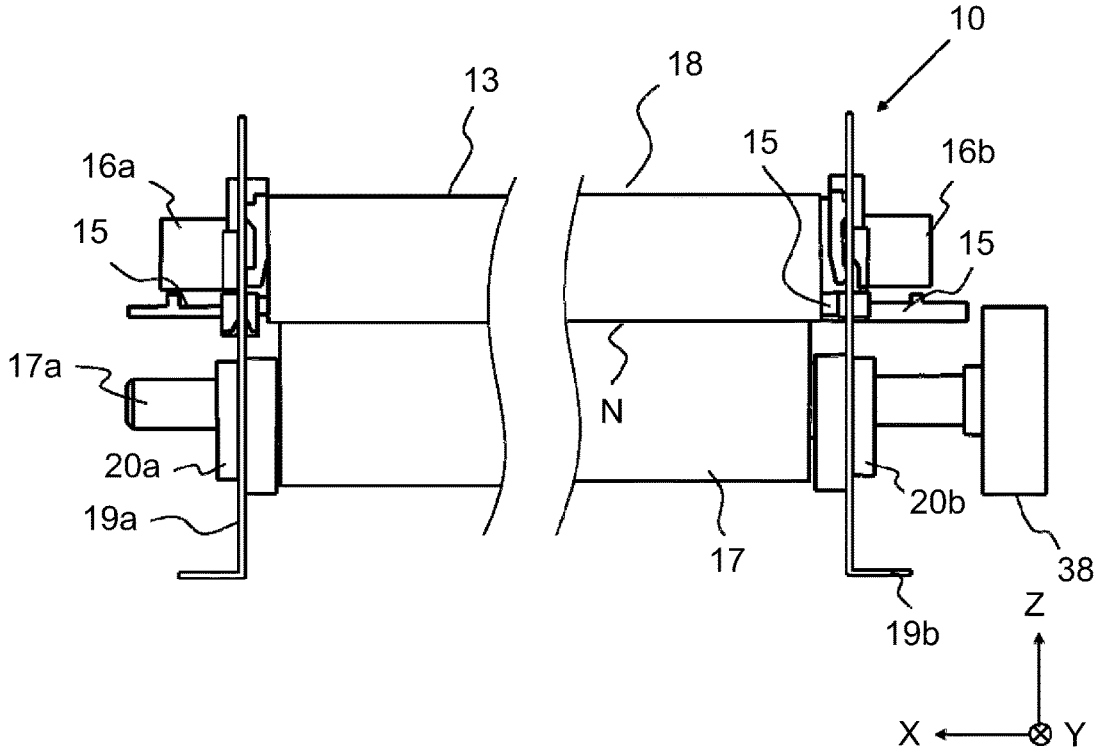
FIG. 1 is a front view of a fixing device in Embodiment 1.
Figure 2:
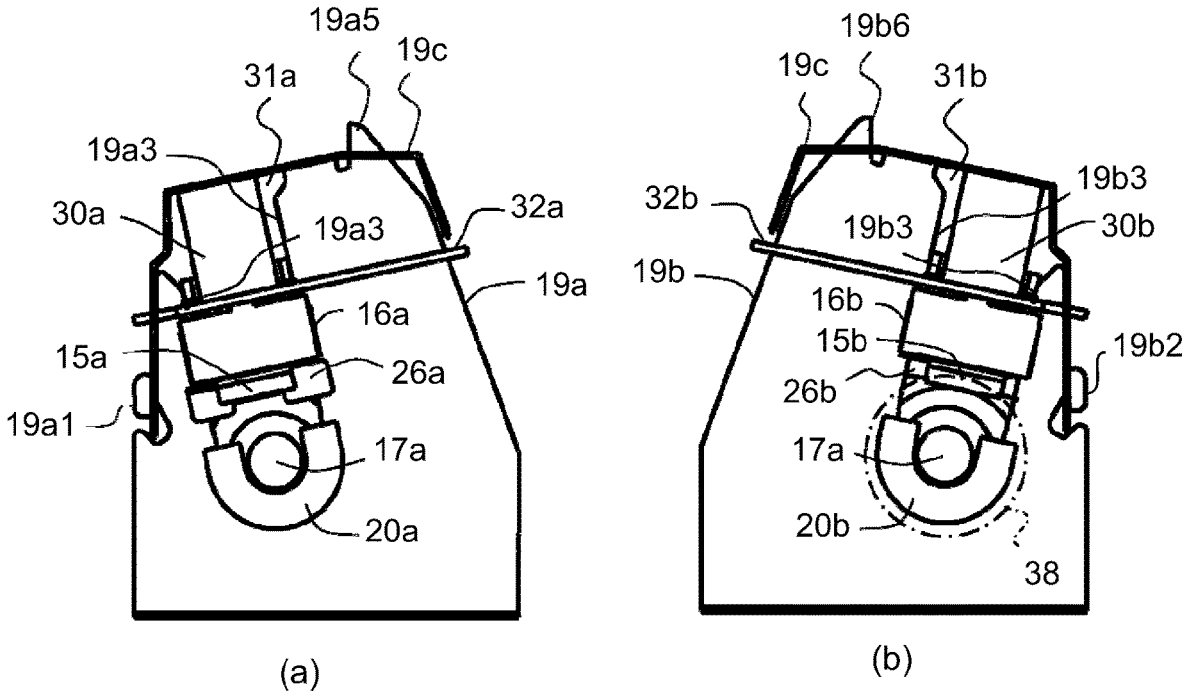
In FIG. 2, parts (a) and (b) are a left side view and a right side view, respectively, of the fixing device in Embodiment 1.
Figure 3:
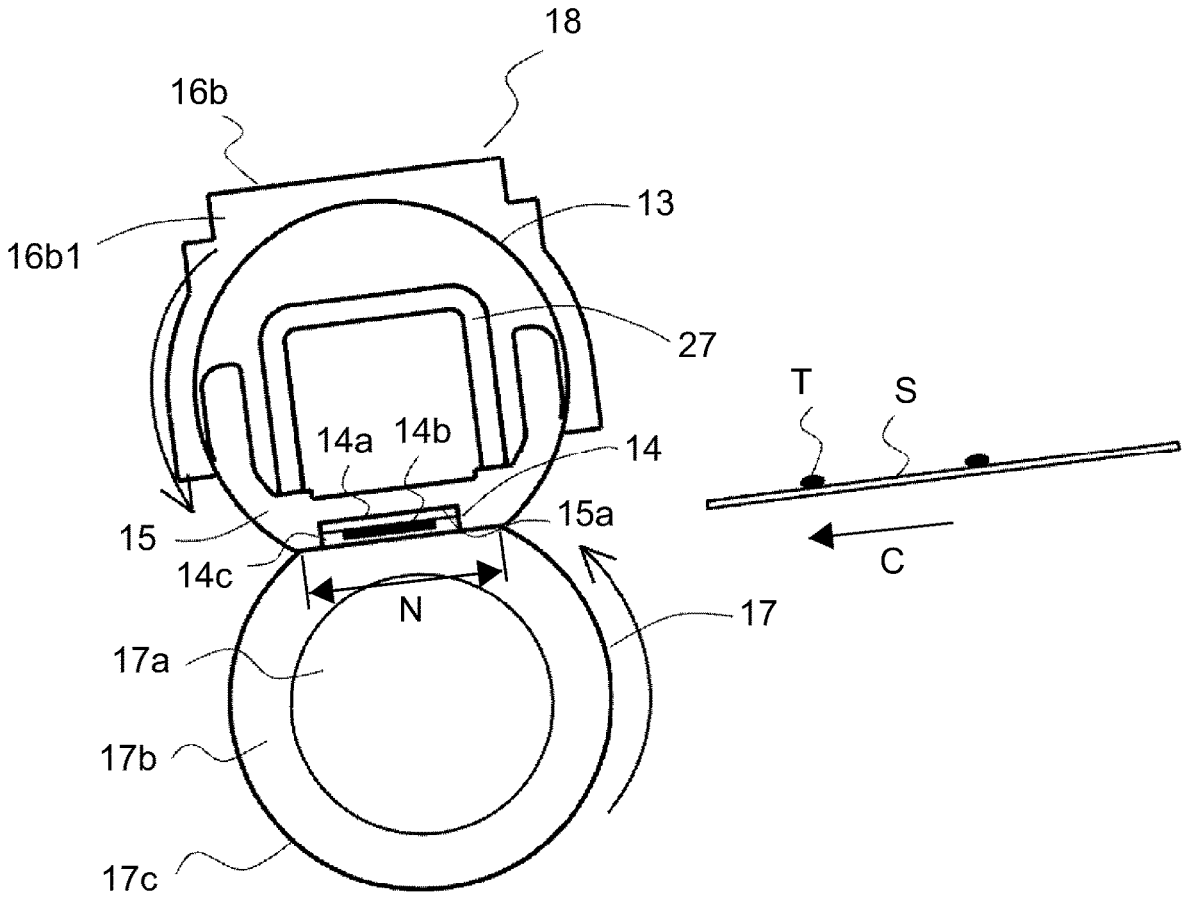
FIG. 3 is a sectional view of the fixing device in Embodiment 1.
Figure 4:
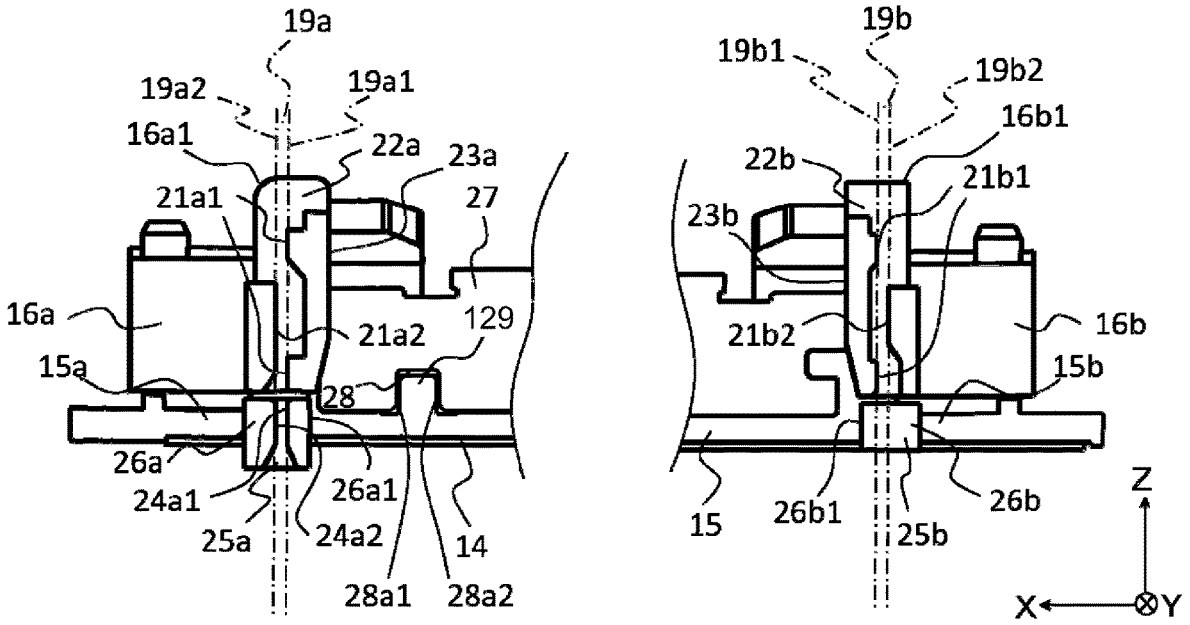
FIG. 4 is a front view of a heating unit in Embodiment 1.
Figure 5:
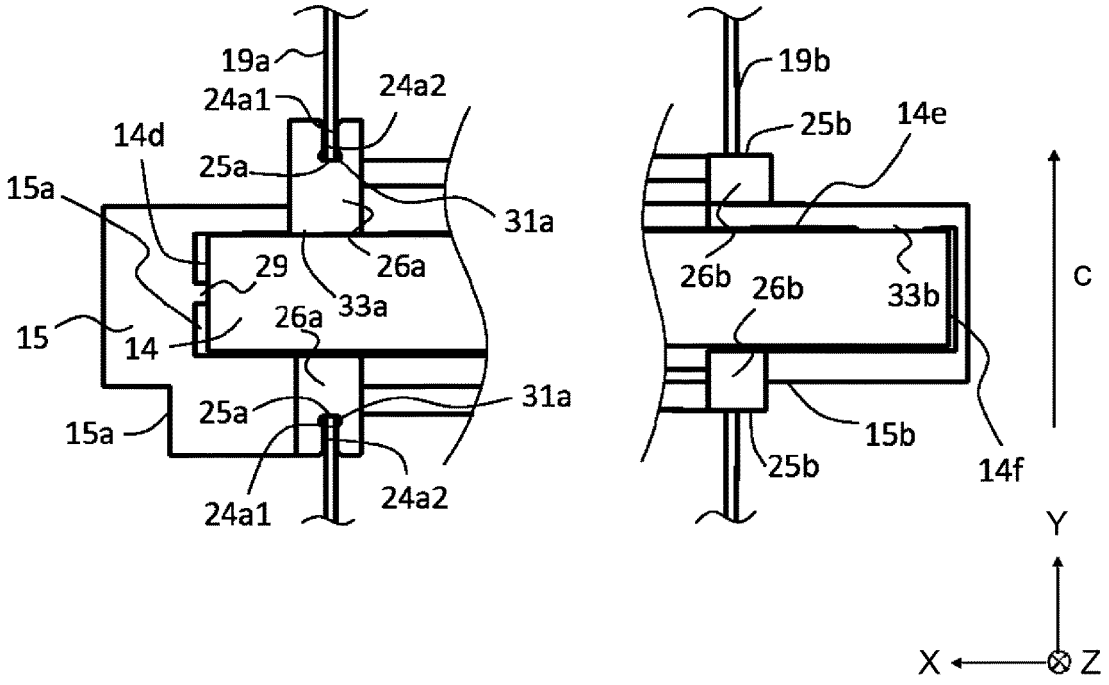
FIG. 5 is a bottom view of the heating unit in Embodiment 1.
Figure 6:
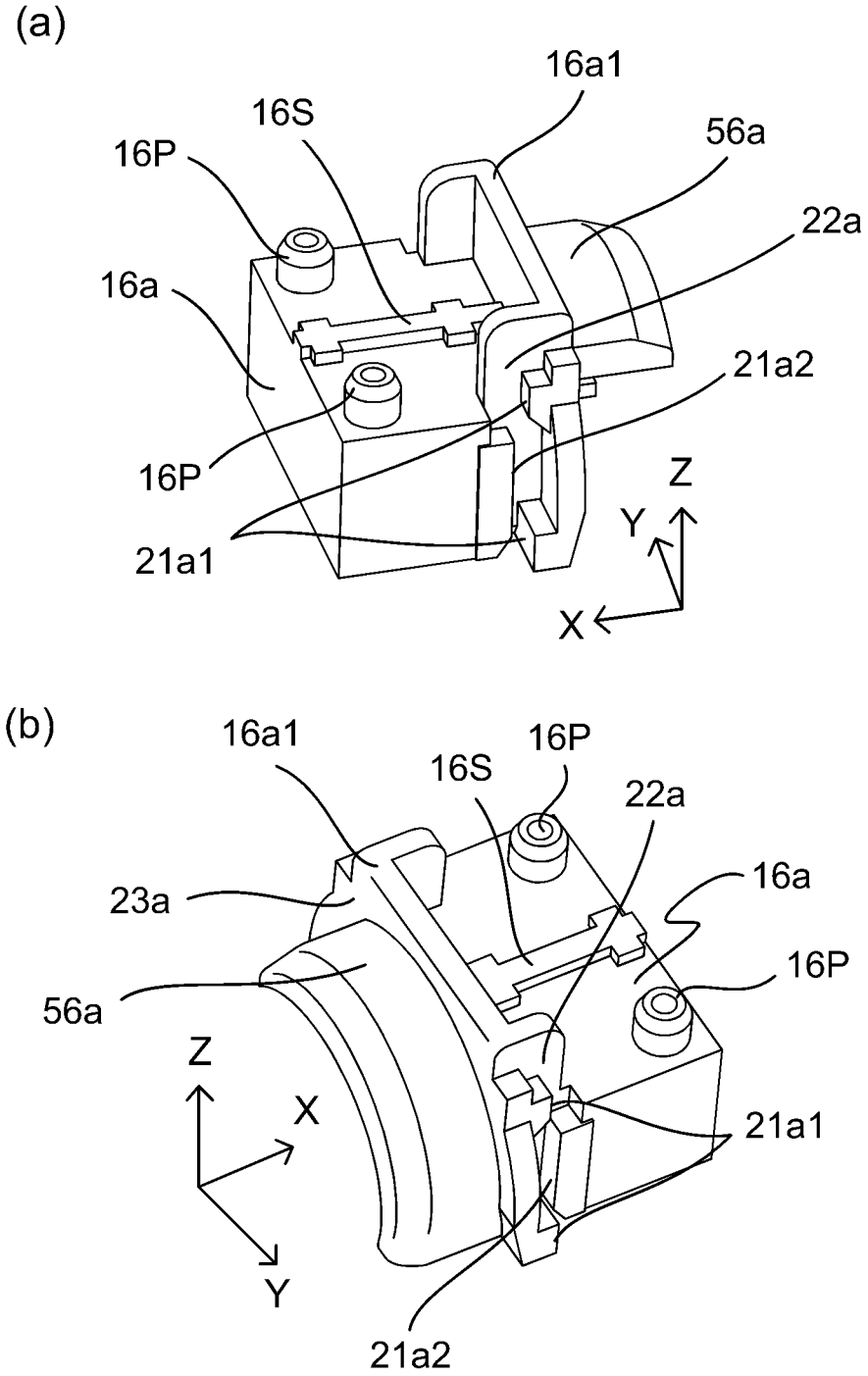
In FIG. 6, parts (a) and (b) are perspective views of a flange.
Figure 7:
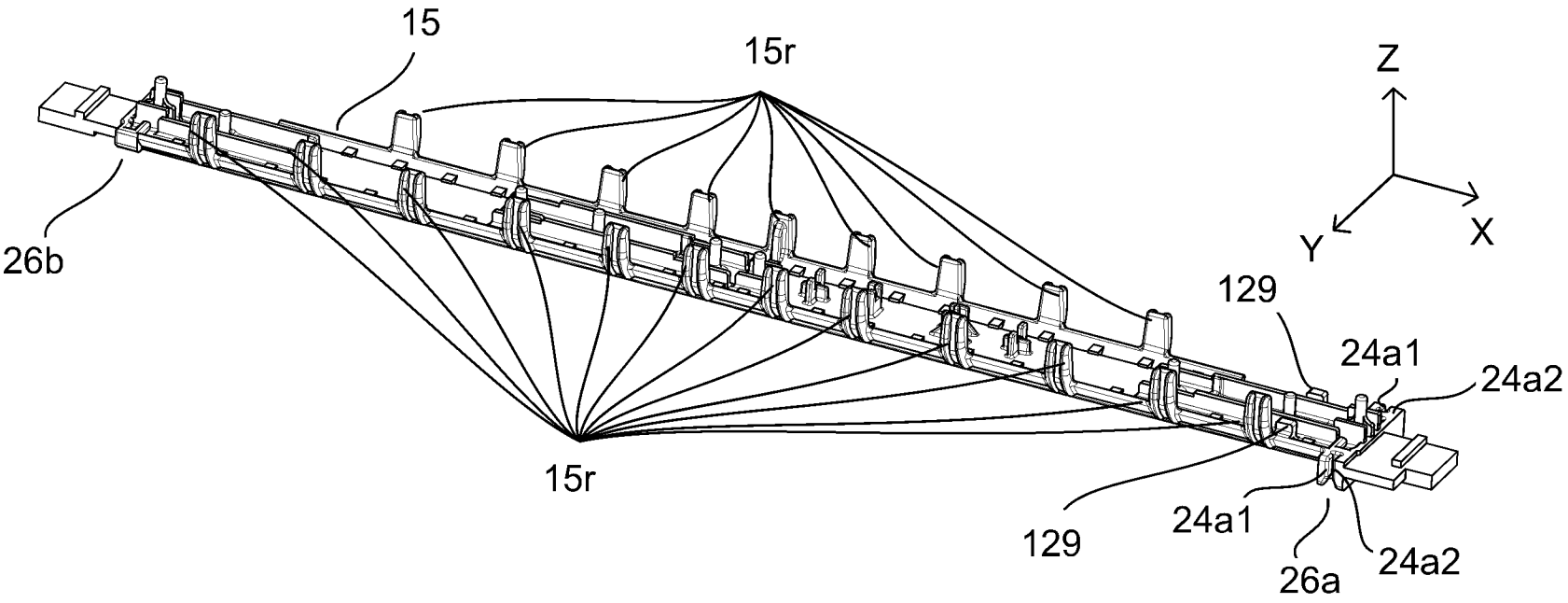
FIG. 7 is a perspective view of a heater holder.
Figure 8:
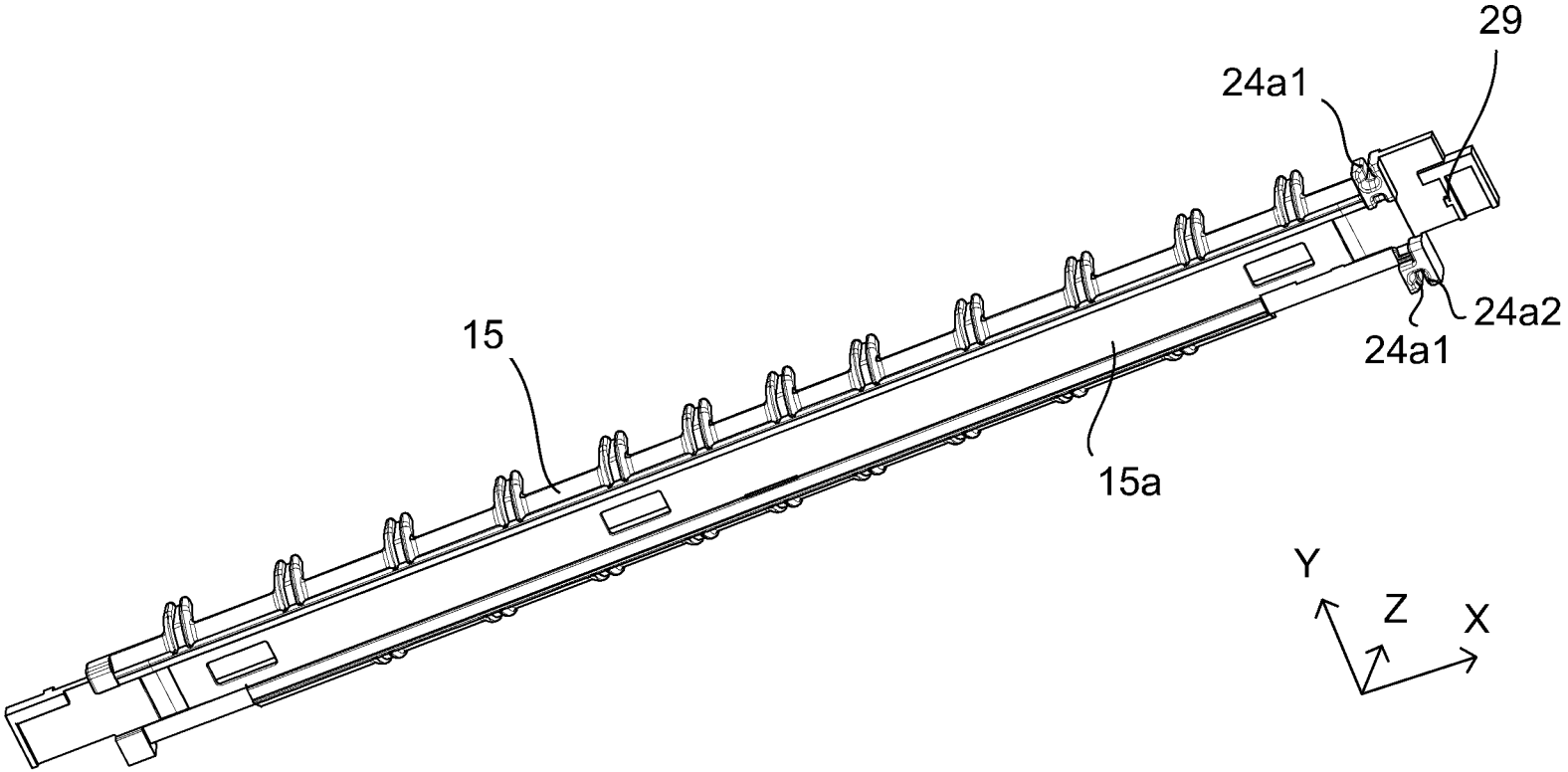
FIG. 8 is a perspective view of the heater holder.
Figure 9:
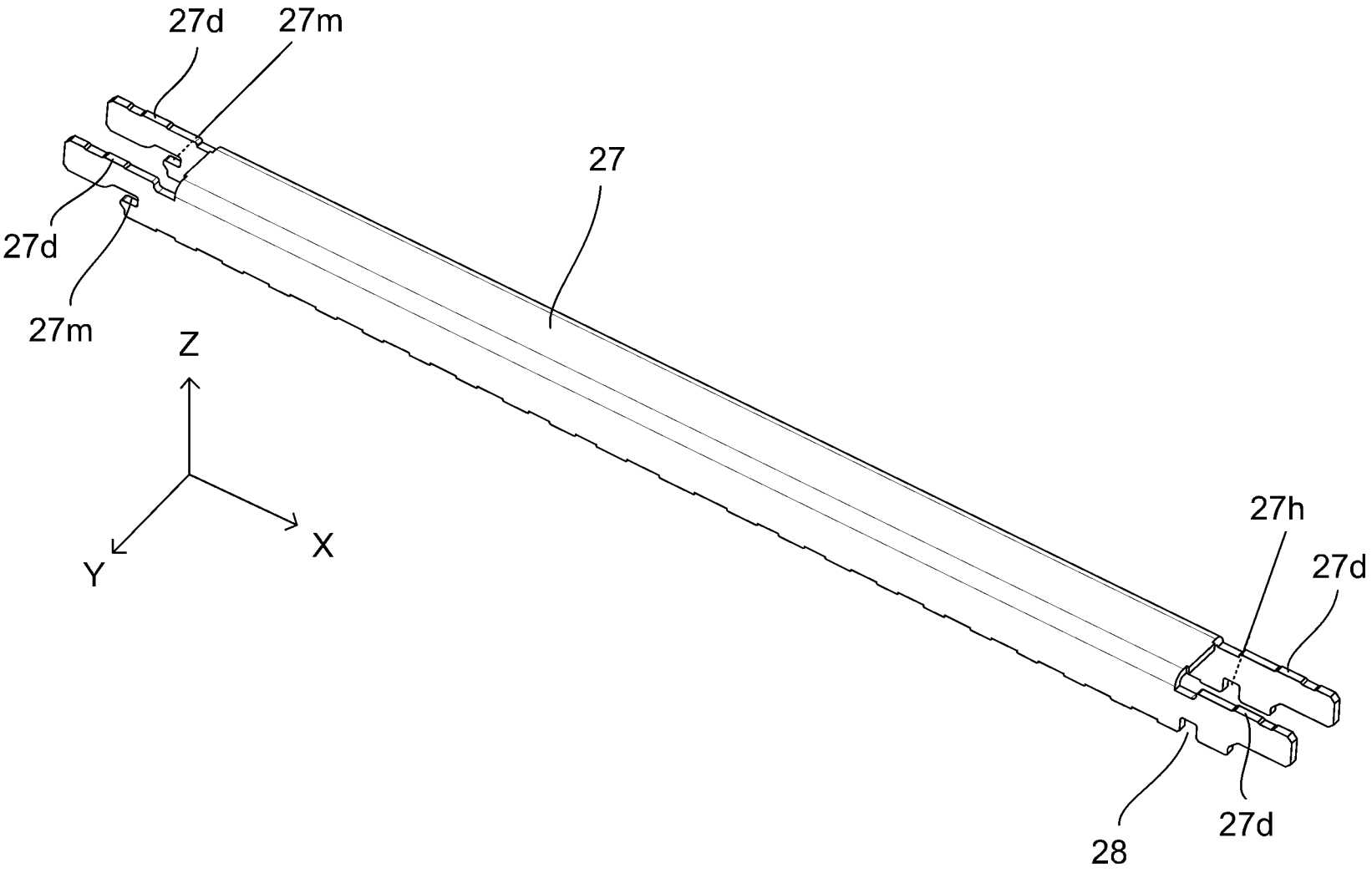
FIG. 9 is a perspective view of a stay.
Figure 10:
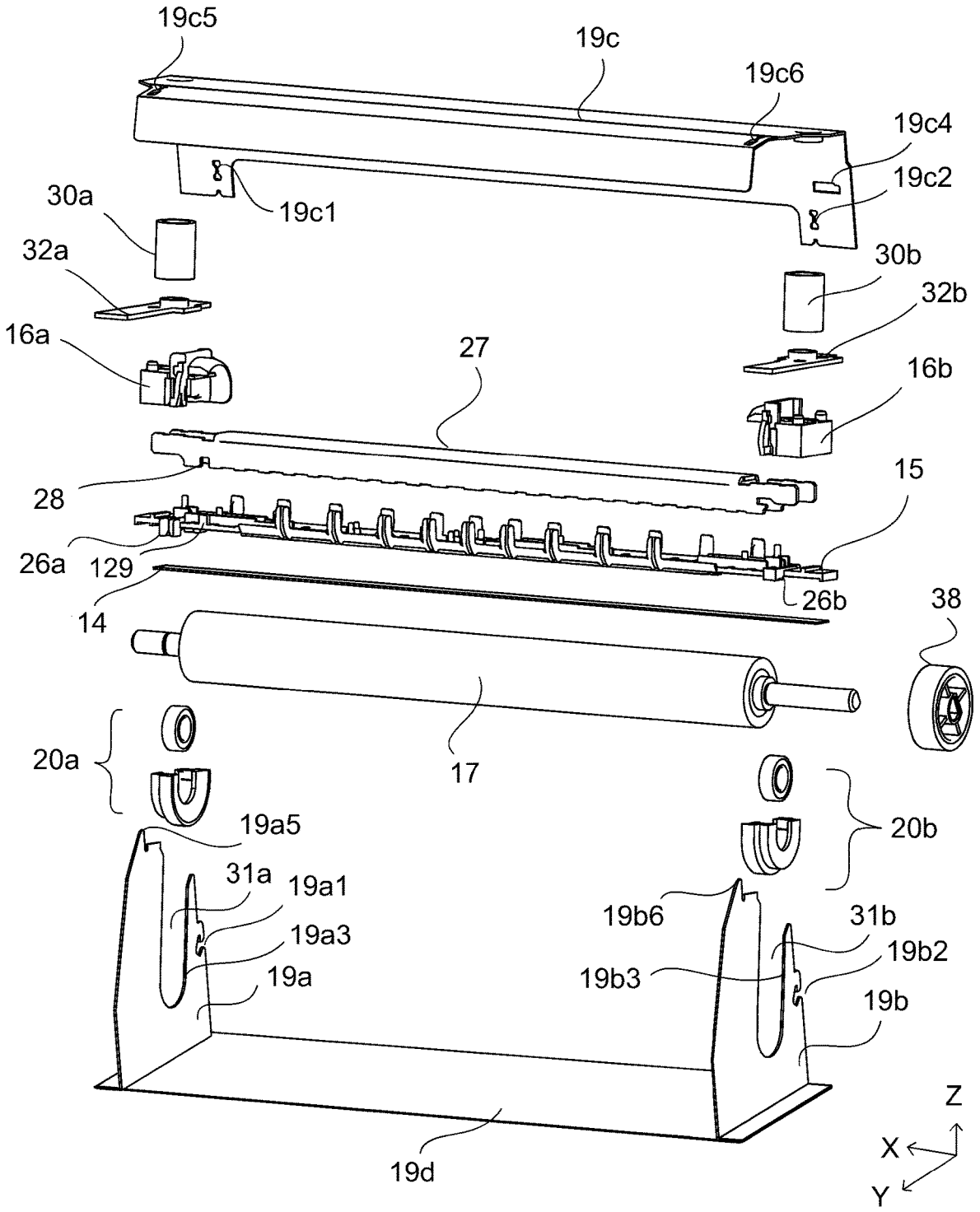
FIG. 10 is an exploded view of the fixing device.

The fixing device 10 in this embodiment will be described with reference to FIGS. 1 to 10. In FIGS. 1 to 5, members that are the same as those in a conventional fixing device will be represented by the same reference numerals or symbols. FIG. 1 is a front view of the fixing device 10 as seen from a downstream side of a feeding direction C of the recording material S (material to be heated). In FIG. 2, (a) is a left side view of the fixing device 10, and (b) is a right side view of the fixing device 10. FIG. 3 is a sectional view of the fixing device 10. FIG. 4 is an enlarged view of left and right end portions of the fixing device 10 of FIG. 1. FIG. 5 is a schematic view of a heating unit 18, in a state in which a pressing roller 17, described later, is demounted, as seen in a Y direction. In FIG. 6, (a) and (b) are perspective views of a flange 16*a*, described later. FIGS. 7 and 8 are perspective views of a heater holder 15, described later. FIG. 9 is a perspective view of a stay 27, described later. FIG. 10 is an exploded view of the fixing device 10. Incidentally, in FIG. 10, a film 13, described later, is omitted.

As shown in FIGS. 1 to 3, the fixing device 10 includes the heating unit 18 and the pressing roller 17. The heating unit 18 includes a cylindrical film 13 as a flexible sleeve (cylindrical rotatable member), a heater 14, and the heater holder 15 as a supporting member for supporting the heater 14. The heating unit 18 further includes the stay 27 for reinforcing the heater holder 15, and flanges 16*a* (first regulating member) and 16*b* (second regulating member) for regulating a position of the film 13 with respect to a longitudinal direction perpendicular to the feeding direction C of the recording material S. The pressing roller 17 includes a metal core 17*a*, an elastic (member) layer 17*b* provided around the metal core 17*a*, and a parting layer (outermost layer) 17*c* provided around the elastic layer 17*b*. A material for the heater holder 15 is a heat resistant resin material, and, in this embodiment, a liquid crystal polymer (LCP) is used. The heater holder 15 is also a guiding member for guiding rotation of the film 13. A material for the stay 27 is metal, and, in this embodiment, a zinc plated steel plate (iron) is used.

The heater holder 15 is disposed in a cylinder of the film 13, so that end portions thereof protrude from an inside of the cylinder of the film 13. At positions opposing the end portions of the heater holder 15, the flanges 16*a* and 16*b* are disposed, respectively.

The heater 14 includes an elongated substrate 14*a* extending in an X axis direction, a heat generating resistor 14*b* provided along a longitudinal direction of the substrate 14*b*, and a protective layer 14*c* covering the heat generating resistor 14*b*. This heater 14 is supported by a recessed portion 15*a* provided at a flat portion of the heater holder 15 so that the protective layer 14*c* slides with an inner surface of the film 13. Left and right frames 19*a* (first side plate) and 19*b* (second side plate), as device frames for positioning the pressing roller 17 with respect to a longitudinal direction (X axis direction) of the fixing device, perpendicular to the feeding direction of the recording material S, include grooves 31*a* and 31*b* (shown, for example, in parts (a) and (b) of FIG. 2), respectively. In the grooves 31*a* and 31*b*, bearings 20*a* and 20*b* are mounted and positioned, respectively, so that both end portions of the metal core 17*a* of the pressing roller 17 are held by the bearings 20*a* and 20*b*. Above the position of the metal core 17*a*, the heater holder 15 is positioned. With respect to the longitudinal direction (X axis direction) of the fixing device, a length of the heater holder (guiding member) 15 is greater than a distance between the frame 19*a* and the frame 19*b*.

As shown in FIGS. 2 and 10, the frames 19*a* and 19*b* are fixed on a lower frame 19*d*. On the frames 19*a* and 19*b*, an upper frame 19*c* is mounted over the frames 19*a* and 19*b*. A hole 19*c*1 provided in the upper frame 19*c* engages with a hook portion 19*a*1 provided in the frame 19*a*. A hole 19*c*2 provided in the upper frame 19*c* engages with a hook portion 19*b*2 provided in the frame 19*b*. A hole 19*c*5 provided in the upper frame 19*c* engages with a projected portion 19*a*5 provided on the frame 19*a*. A hole 19*c*6 provided in the upper frame 19*c* engages with a projected portion 19*b*6 provided on the frame 19*b*.

When the fixing device is assembled, into a groove 31*a* of the frame 19*a* and a groove 31*b* of the frame 19*b*, the respective members are inserted (disposed) in the listed order shown below. The first members (lowermost) are the bearings 20*a* and 20*b* for holding the shaft of the pressing roller 17, the second member is the heater holder 15 in a state of holding the heater 14, the third member is the stay 27, and the fourth members are the flanges 16*a* and 16*b*. Of these members, the members contacting an edge portion 19*a*3 of the frame 19*a* forming the groove 31*a* and an edge portion 19*b*3 of the frame 19*b* forming the groove 31*b* are the bearings 20*a* and 20*b*, the heater holder 15, and the flanges 16*a* and 16*b*.

In the groove 31*a* of the frame 19*a* and the groove 31*b* of the frame 19*b*, the flanges 16*a* and 16*b* are positioned, respectively, above the position of the heater holder 15 so as to be slidable vertically, so that a longitudinal position of the film 13 is regulated between the both flanges 16*a* and 16*b*. That is, the flange 16*a* is a member with which one end surface of the film 13 is in contact when the film 13 moves toward the frame 19*a*, and prevents movement of the film 13 in the longitudinal direction. Further, the flange 16*b* is a member with which the other end surface of the film 13 is in contact when the film 13 moves toward the frame 19*b*, and prevents movement of the film 13 in the longitudinal direction.

The flanges 16*a* and 16*b* (as shown in parts (a) and (b) of FIG. 2), disposed at positions opposing the end portion surfaces of the film 13, are urged (pressed) toward a direction perpendicular to a generatrix direction of the pressing roller 17 by urging (pressing) springs 30*a* and 30*b*, respectively, as urging (pressing) members via urging (pressing) plates 32*a* and 32*b*. Both of the pressing springs 30*a* and 30*b* are compression springs, and each of these compression springs is sandwiched between the upper frame 19*c* and the associated pressing plate. As shown in FIG. 10, one end of the pressing plate 32*a* is inserted into a hole (not shown) provided in the upper frame 19*c*. One end of the pressing plate 32 is inserted into a hole 19*c*4 provided in the upper roller 19*c*.

Next, a structure of the flanges 16*a* and 16*b* will be described. In FIG. 6, parts (a) and (b) are perspective views of the flange 16*a*. Incidentally, a structure of the flange 16*b* is substantially the same as the structure of the flange 16*a*, and, therefore, will be omitted from description.

The flange 16*a* includes a guiding portion 56*a*, a bearing surface portion 16S contactable to the pressing plate 32*a*, a positioning portion for positioning the pressing plate 32*a*, and a regulating portion 16*a*1 having a surface 23*a* contactable to an end surface of the film 13. Positioning portions

21*a*1 and 21*a*2 position the flange 16*a* relative to the frame 19*a* with respect to the X direction.

Next, a structure of the heater holder 15 will be described. The heater holder 15 has the function of guiding the rotation of the film 13. FIGS. 7 and 8 are perspective views of the heater holder 15. The heater holder 15 includes ribs 15*r* for guiding the rotation of the film 13 and a recessed portion 15*a* in which the heater 14 is engaged. Positioning portions 24*a*1 and 24*a*1 position the heater holder 15 relative to the frame 19*a* with respect to the X direction. A positioning portion 129 positions the stay 27 with respect to the X direction.

Next a structure of the stay 27 will be described. FIG. 9 is a perspective view of the stay 27. The stay 27 includes force receiving portions 27*d* for receiving forces of the pressing springs 30*a* and 30*b* in contact with the flanges 16*a* and 16*b*, and includes engaging portions 27*m* for engaging with the heater holder 15 when the stay 27 is mounted on the heater holder 15 while sliding the stay 27 in a negative (minus) X direction. A positioning portion 28 positions the stay 27 relative to the heater holder 15 with respect to the X direction. The positioning portion 28 contacts a positioning portion 129 of the heater holder 15. The stay 27 presses the heater holder 15 by receiving pressing (urging) forces from the flanges 16*a* and 16*b*. The heater 14 is press contacted to the inner surface of the film 13 by the heater holder 15, so that the heater 14 forms a nip N in cooperation with the pressing roller 17 via the film 13.

In the fixing device 10 in this embodiment, the pressing roller 17 is rotationally driven in an arrow direction (FIG. 3) via a gear 38 (FIG. 1) by the drive of a motor (not shown). The film 13 is driven by the rotation of the pressing roller 17 to rotate in an arrow direction, while the inner surface of the film 13 slides with the protective layer 14*c* of the heater 14.

The gear 38, as a gear for driving the pressing roller 17, is a helical gear, and generates thrust in a direction (X direction) in which the pressing roller 17 moves toward the frame 19*a* during the drive of the pressing roller 17, so that the pressing roller 17 is shifted toward the frame 19*a* side. That is, the thrust, in the axial direction, generated during the drive of the pressing roller 17 is caused to generate in a positioning direction of the heater holder 15. The heater 14 generates heat by energization to the heat generating resistor 14*b*.

The recording material S, carrying the unfixed toner image T, is heated while being nipped and fed at the nip N, so that the toner image T is fixed on the recording material S.

FIG. 4 is a front view of the heating unit 18, from which the film 13 is demounted, as seen from the downstream side with respect to the feeding direction C of the recording material S. With reference to FIG. 4, parts (a) and (b) of FIG. 6, and FIG. 10, positioning between the left side flange 16*a* and the frame 19*a* and positioning between the right side flange 16*b* and the frame 19*b* will be described.

First, the positioning of the flange 16*a* relative to the frame 19*a* (indicated by a chain line) will be described. The flange 16*a* includes a position regulating portion 16*a*1 for regulating a position of a left side end portion of the film 13. The position regulating portion 16*a*1 is formed from an upstream side toward a downstream side of the flange 16*a* with respect to the feeding direction C of the recording material S. The position regulating portion 16*a*1 is provided with first positioning portions 21*a*1, a second positioning portion 21*a*2, and a third positioning portion 22*a*. By these positioning portions, the flange 16*a* is positioned relative to the frame 19*a*.

With respect to the longitudinal direction (X axis direction) of the pressing roller 17, the positioning portions 21*a*1 oppose an inside surface 19*a*1 of the frame 19*a*, and the positioning portion 21*a*2 opposes an outside surface 19*a*2 of the frame 19*a*. With respect to the feeding direction C (Y axis direction) of the pressing roller 17, the positioning portion 22*a* opposes an edge portion 19*a*3 (shown in part (a) of FIG. 2 and FIG. 10) of the frame 19*a* forming the groove 31*a*.

Therefore, the flange 16*a* is positioned relative to the frame 19*a* by the positioning portions 21*a*1 and 21*a*2 with respect to the X axis direction and by the positioning portion 22*a* with respect to the Y axis direction.

Next, the positioning of the flange 16*b* relative to the frame 19*b* (indicated by a chain line) will be described. The flange 16*b* includes a position regulating portion 16*b*1 for regulating a position of a right side end portion of the film 13. Also, the position regulating portion 16*b*1 is formed from an upstream side toward a downstream side of the flange 16*b* with respect to the feeding direction C of the recording material S. The position regulating portion 16*b*1 is provided with first positioning portions 21*b*1, a second positioning portion 21*b*2, and a third positioning portion 22*b*. By these positioning portions, the flange 16*b* is positioned relative to the frame 19*b*.

With respect to the longitudinal direction (X axis direction) of the pressing roller 17, the positioning portions 21*b*1 oppose an inside surface 19*b*1 of the frame 19*b*, and the positioning portion 21*b*2 opposes an outside surface 19*b*2 of the frame 19*b*. With respect to the feeding direction C (Y axis direction) of the pressing roller 17, the positioning portion 22*b* opposes an edge portion 19*b*3 (shown in part (b) of FIG. 2 and FIG. 10) of the frame 19*b* forming the groove 31*b*.

Therefore, the flange 16*b* is positioned relative to the frame 19*b* by the positioning portions 21*b*1 and 21*b*2 with respect to the X axis direction and by the positioning portion 22*b* with respect to the Y axis direction.

With respect to the X axis direction, the position of the film 13 is regulated by surfaces 23*a* and 23*b*, on the film 13 side of the position regulating portions 16*a*1 and 16*a*2 of the flanges 16*a* and 16*b*, respectively. These surfaces 23*a* and 23*b* are positioned closer to the film 13 than are surfaces 26*a*1 and 26*b*1, on the film 13 side, of first and second end portion positioning portions 26*a* and 26*b*, described later, of the heater holder 15. That is, the surfaces 26*a*1 and 26*b*1 of the heater holder 15 are disposed outside the surfaces 23*a* and 23*b* of the flanges 16*a* and 16*b* with respect to the fixing device longitudinal direction (X axis direction).

For this reason, the end portion positioning portions 26*a* and 26*b* of the heater holder 15 do not contact the end portions of the film 13.

Next, with reference to FIGS. 4, 7, 8, and 10, positioning of the heater holder 15 relative to the frames 19*a* and 19*b* will be described.

The heater holder 15 includes the end portion positioning portion 26*a* for positioning the heater holder 15 relative to the frame 19*a* with respect to the X axis direction and the Y axis direction. Here, the end portion positioning portion 26*a* is disposed at a left side end portion 15*a* of the heater holder 15 in the same side as a side on which a first abutment portion 29, described later, for positioning the heater 14 relative to the heater holder 15 with respect to the X axis direction is provided. The end portion positioning portion 26*a* is provided with first positioning portions 24*a*1, a second positioning portion 24*a*2, and a third positioning portion 25*a*.

With respect to the X axis direction, the positioning portions 24*a*1 oppose the inside frame surface 19*a*1, and the positioning portion 24*a*2 opposes the outside frame surface 19*a*2. With respect to the Y axis direction, the positioning portion 25*a* opposes the edge portion 19*a*3 (shown in part (a) of FIG. 2 and FIG. 10) of the frame 19*a* forming the groove 31*a*.

Therefore, the heater holder 15 is positioned relative to the frame 19*a* by the positioning portions 24*a*1 and 24*a*2 with respect to the X axis direction and by the positioning portion 25*a* with respect to the Y axis direction.

Between the positioning portions 24*a*1 and 24*a*2, a gap, determined in consideration of dimensional tolerances and thermal expansion of components (portions), is provided. The frame 19*a* is formed with a steel plate, and a plate thickness is from 0.6 mm to 1.2 mm. For that reason, the gap can be made relatively small.

Further, the heater holder 15 includes the end portion positioning portion 26*b* for positioning the heater holder 15 relative to the frame 19*b* with respect to the Y axis direction. The end portion positioning portion 26*b* has no positioning function relative to the frame 19*b* with respect to the X axis direction. The end portion positioning portion 26*b* is provided with a third positioning portion 25*b*.

With respect to the Y axis direction, the positioning portion 25*b* opposes the edge portion 19*b*3 (shown in part (b) of FIG. 2 and FIG. 10) of the frame 19*b* forming the groove 31*b*.

Therefore, the heater holder 15 is positioned relative to the frame 19*b* with respect to the Y axis direction by the positioning portion 25*b* for the frame 19*b*, but is not positioned relative to the frame 19 with respect to the X axis direction.

Next, with reference to FIG. 4, positioning between the heater holder 15 and the stay 27 will be described. At the end portion of the stay 27, in the frame 16*a* side, disposed on the heater holder 15, a recessed shaped groove 28 is formed. The groove 28 includes positioning portions 28*a*1 and 28*a*2 for positioning the stay 27 relative to the heater holder 15 with respect to the X axis direction. The heater holder 15 is provided with a projected shaped portion 129 with which the groove 28 engages.

Therefore, the stay 27 is positioned relative to the heater holder 15 with respect to the X axis direction by the positioning portions 28*a*1 and 28*a*2, but is not positioned relative to the heater holder 15 with respect to the Y axis direction.

Next, with reference to FIGS. 5, 8, and 10, positioning of the heater 14 relative to the heater holder 15 will be described. FIG. 5 is a bottom view of the heating unit 18, from which the film 13 is demounted, as seen from the heater 14 side.

With respect to the X axis direction, on an inner surface of the heater holder 15 at the recessed portion 15*a* in the frame 19*a* side, a first abutment portion 29 is provided. Further, on the inner surface at the recessed portion 15*a* in a downstream side with respect to the feeding direction C (Y axis direction) of the recording material S, a second abutment portion 33*a* and a third abutment portion 33*b* are provided. The second abutment portion 33*a* is in the same position as the end portion positioning portion 26*a* with respect to the X axis direction but is positioned toward the outside relative to the end portion positioning portion 26*a* with respect to the X axis direction.

In the recessed portion 15*a*, one longitudinal end 14*d* of the heater 14 is abutted against the first abutment portion 29, and a downstream side surface 14*e* of the heater 14 with respect to the Y axis direction is abutted against the second abutment portion 33*a* and the third abutment portion 33*b*.

Therefore, in the recessed portion 15*a*, the heater 14 is positioned with respect to the X axis direction by the abutment portion 29 and is positioned with respect to the Y axis direction by the abutment portions 33*a* and 33*b*. The other end 14*f* of the heater 14 with respect to the X axis direction is made free, and is not abutted against the heater holder 15, and thus can absorb the dimensional tolerance and the thermal expansion of the components.

As described above, the heater holder 15 includes the positioning portion 26*a*, contacting the frame 19*a*, for determining the position of the heater holder 15 with respect to the longitudinal direction (X axis direction) of the fixing device. As a result, positional accuracy of the heater 14 with respect to the longitudinal direction of the fixing device is enhanced, so that heat of the heater 14 can be effectively used and electrical power consumption can be suppressed.

Further, in this embodiment, the position of the stay 27 with respect to the X axis direction is determined by the heater holder 15. By this constitution, for example, it is possible to decrease a difference in distribution, with respect to the X axis direction, of a width of the fixing nip N (with respect to the feeding direction C (Y axis direction) between a printer A and a printer B manufactured by the same manufacturing line. For this reason, heat of the heater 14 can be effectively used, so that electrical power consumption can be suppressed.

Further, an urging direction by the helical gear 38 is set in a positive X direction. As a result, when the helical gear 38 rotates, the pressing roller 17 shifts toward the frame 19*a* side. As described above, with respect to the X axis direction, the heater holder 15 is positioned relative to the frame 19*a*. Further, the position of the heater 14 is determined by the positioning portion 29 of the heater holder 15, but the positioning portion 29 is provided at a position closer to the frame 19*a* than to the frame 19*b*. Thus, with respect to the X axis direction, the positions of the pressing roller 17, the heater holder 15, and the heater 14 are determined on the basis of the frame 19*a*. By this constitution, among individual printers, a deviation between a heat generating region of the heater 14 with respect to the X axis direction and the position of the nip N with respect to the X axis direction becomes small. For this reason, the heat of the heater 14 can be effectively used and the electrical power consumption can be suppressed.

Further, also the positioning portion 28, of the heater holder 15, for positioning the stay 27 is provided at a position closer to the frame 19*a* than to the frame 19*b*. By these constitutions, in a case in which the respective members are expanded by heat, any of the members extends in a direction (X direction) from the frame 19*a* toward the frame 19*b*, and, therefore, a positional deviation between the respective members can be suppressed to a low level.

As described above, in the fixing device 10 in this embodiment, the left side end portion 15*a* of the heater holder 15 is positioned in the groove 31*a* of the frame 19*a* via the end portion positioning portion 26*a*, and, therefore, positional accuracy of the heater 14 relative to the frame 19*a* is improved.

Embodiment 2

Figure 11:
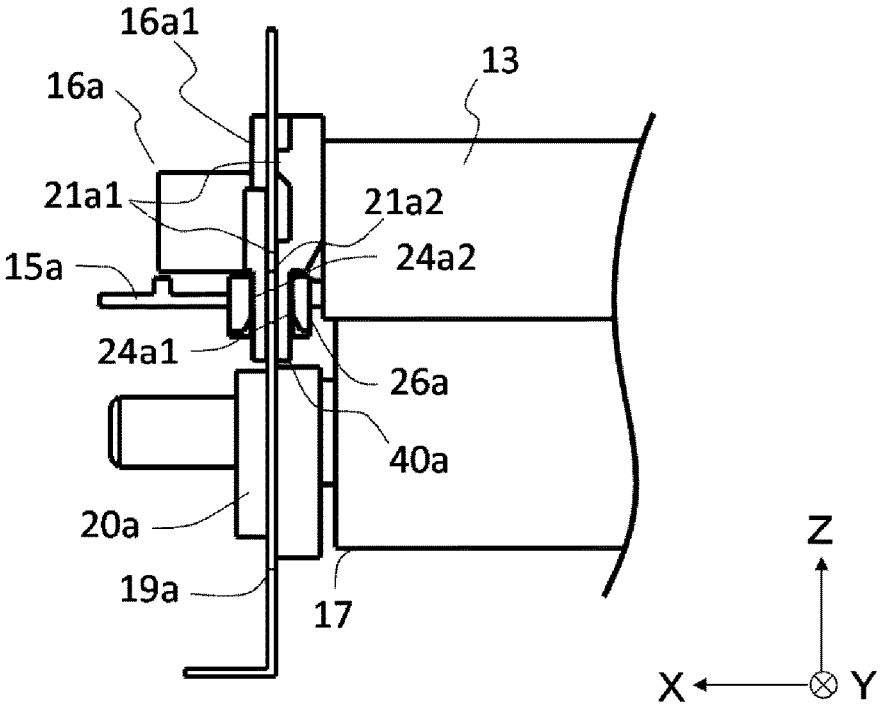
FIG. 11 is a front view showing a left side end portion of a fixing device in Embodiment 2.

With reference to FIG. 11, a fixing device 10 in this embodiment will be described. FIG. 11 is a front view of a left side end portion of the fixing device 10 in this embodiment as seen from a downstream side with respect to the feeding direction C of the recording material S.

In this embodiment, only the fixing device 10 is different from the fixing device 10 in Embodiment 1 described above, and, therefore, the different portions will be principally described, and portions having the same constitutions as those in Embodiment 1 are represented by the same reference numerals or symbols, and will be omitted from description. This is true for also Embodiments 3 to 6.

With respect to the longitudinal direction of the pressing roller 17, the flange 16*a* is positioned relative to the frame 19*a* by the positioning portions 21*a*1 and 21*a*2 of the position regulating portion 16*a*1. Further, a projected positioning portion 40*a*, provided at a portion at which the position regulating portion 16*a*1 is positioned relative to the frame 19*a*, is sandwiched between the positioning portions 24*a*1 and 24*a*2 of the end portion positioning portion 26*a* of the heater holder 15, so that positioning of the heater holder 15 is made possible.

Between the positioning portions 24*a*1 and 24*a*2 of the heater holder 15, a gap, determined in consideration of dimensional tolerances and thermal expansion of components, is provided. A dimension, with respect to the roller longitudinal direction Y, of the projected positioning portion 40*a* of the flange 16*a* by which the heater holder 15 is positioned is from 4 mm to 6 mm. For that reason, the above described gap can be made relatively small.

As described above, in the fixing device 10 in this embodiment, the left side end portion 15*a* of the heater holder 15 is positioned in the groove 31*a* of the frame 19*a* via the flange 16*a*, and, therefore, positional accuracy of the heater 14 relative to the frame 19*a* is improved.

Embodiment 3

Figure 12:
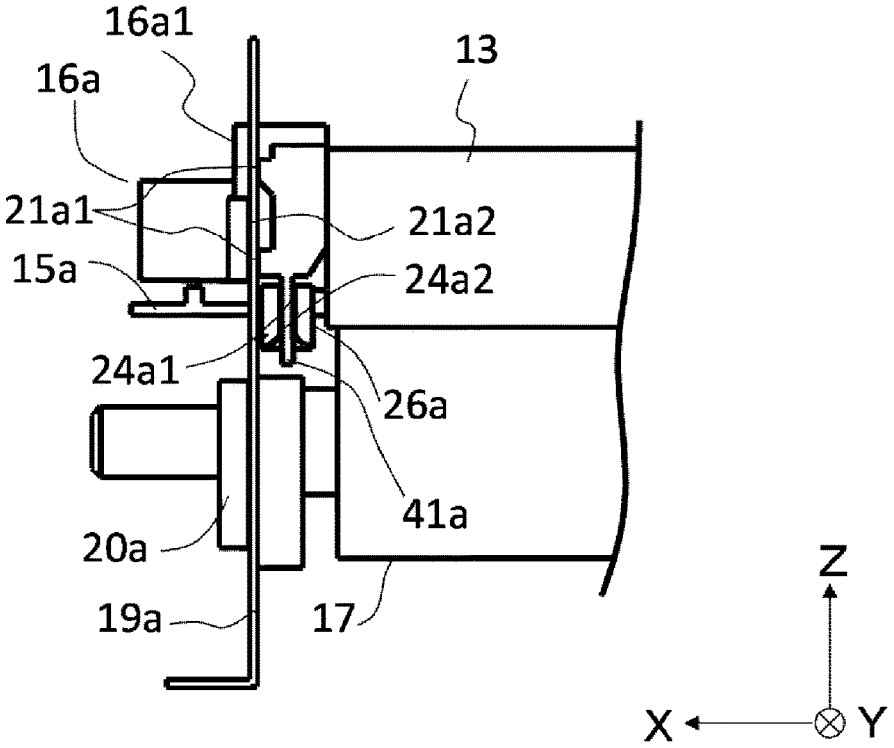
FIG. 12 is a front view showing a left side end portion of a fixing device in Embodiment 3.

With reference to FIG. 12, a fixing device 10 in this embodiment will be described. FIG. 12 is a front view of a left side end portion of the fixing device 10 in this embodiment as seen from a downstream side with respect to the feeding direction C of the recording material S.

With respect to the longitudinal direction of the pressing roller 17, the flange 16*a* is positioned relative to the frame 19*a* by the positioning portions 21*a*1 and 21*a*2 of the position regulating portion 16*a*1. Further, a rib 41*a*, provided at a portion other than a portion at which the position regulating portion 16*a*1 is positioned relative to the frame 19*a*, is sandwiched between the positioning portions 24*a*1 and 24*a*2 of the end portion positioning portion 26*a* of the heater holder 15, so that positioning of the heater holder 15 is made possible.

Between the positioning portions 24*a*1 and 24*a*2 of the heater holder 15, a gap, determined in consideration of dimensional tolerances and thermal expansion of components, is provided. A dimension, with respect to the roller longitudinal direction Y, of the rib 41*a* of the flange 16*a* by which the heater holder 15 is positioned is from 1 mm to 3 mm. For that reason, the above described gap can be made relatively small.

As described above, in the fixing device 10 in this embodiment, the left side end portion 15*a* of the heater holder 15 is positioned in the groove 31*a* of the frame 19*a* via the flange 16*a*, and, therefore, positional accuracy of the heater 14 relative to the frame 19*a* is improved.

Embodiment 4

Figure 13:
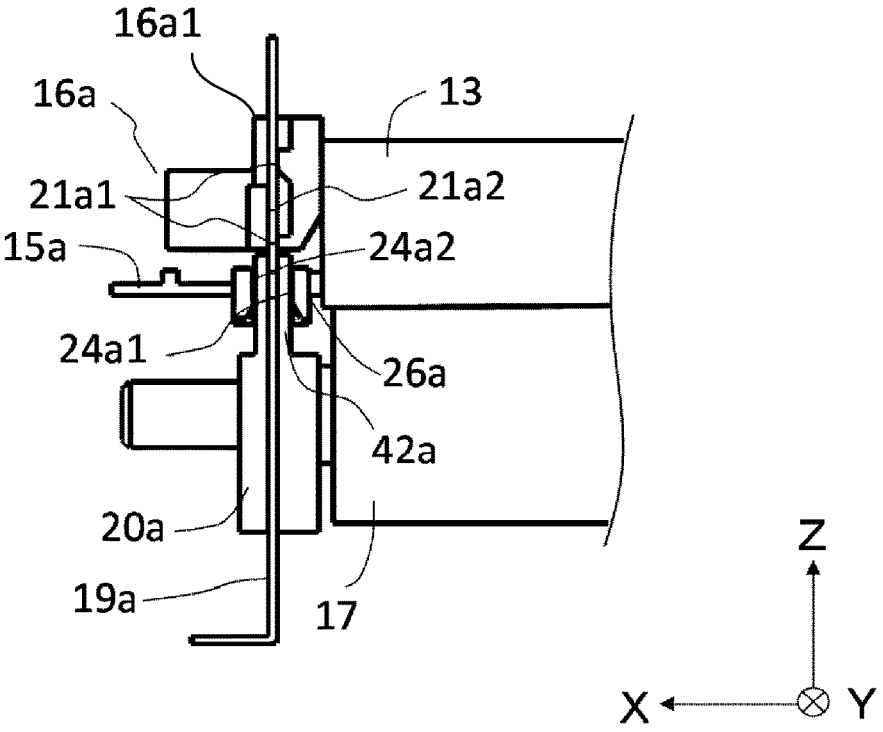
FIG. 13 is a front view showing a left side end portion of a fixing device in Embodiment 4.

With reference to FIG. 13, a fixing device 10 in this embodiment will be described. FIG. 13 is a front view of a left side end portion of the fixing device 10 in this embodiment as seen from a downstream side with respect to the feeding direction C of the recording material S.

With respect to the longitudinal direction of the pressing roller 17, the flange 16*a* is positioned relative to the frame 19*a* by the positioning portions 21*a*1 and 21*a*2 of the position regulating portion 16*a*1. Further, a projected positioning portion 42*a*, provided at a portion at which the bearing 20*a* as a separate member is positioned relative to the frame 19*a*, is sandwiched between the positioning portions 24*a*1 and 24*a*2 of the end portion positioning portion 26*a* of the heater holder 15, so that positioning of the heater holder 15 is made possible.

Between the positioning portions 24*a*1 and 24*a*2 of the heater holder 15, a gap, determined in consideration of dimensional tolerances and thermal expansion of components, is provided. A dimension, with respect to the longitudinal direction of the pressing roller 17, of the projected positioning portion 40*a* of the bearing 20*a* by which the heater holder 15 is positioned is from 4 mm to 6 mm. For that reason, the above described gap can be made relatively small.

As described above, in the fixing device 10 in this embodiment, the left side end portion 15*a* of the heater holder 15 is positioned in the groove 31*a* of the frame 19*a* via the bearing 20*a*, and, therefore, positional accuracy of the heater 14 relative to the frame 19*a* is improved.

Embodiment 5

Figure 14:
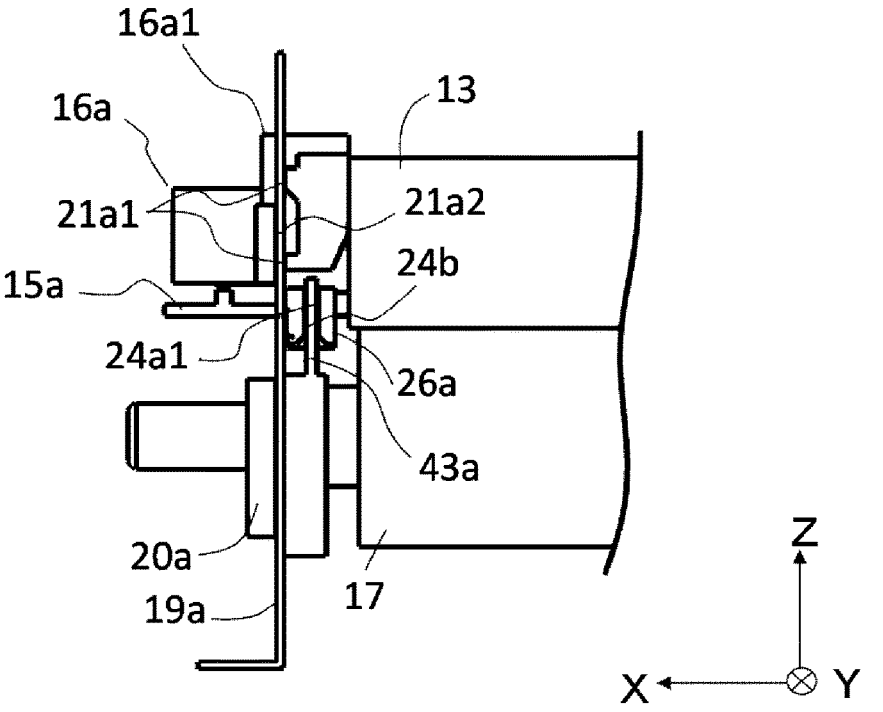
FIG. 14 is a front view showing a left side end portion of a fixing device in Embodiment 5.

With reference to FIG. 14, a fixing device 10 in this embodiment will be described. FIG. 14 is a front view of a left side end portion of the fixing device 10 in this embodiment as seen from a downstream side with respect to the feeding direction C of the recording material S.

With respect to the longitudinal direction of the pressing roller 17, the flange 16*a* is positioned relative to the frame 19*a* by the positioning portions 21*a*1 and 21*a*2 of the position regulating portion 16*a*1. Further, a rib 43*a*, provided at a portion other than a portion at which the bearing 20*a* as a separate member is positioned relative to the frame 19*a*, is sandwiched between the positioning portions 24*a*1 and 24*a*2 of the end portion positioning portion 26*a* of the heater holder 15, so that positioning of the heater holder 15 is made possible.

Between the positioning portions 24*a*1 and 24*a*2 of the heater holder 15, a gap, determined in consideration of dimensional tolerances and thermal expansion of components, is provided. A dimension, with respect to the longitudinal direction of the pressing roller 17, of the rib 43*a* of the bearing 20*a*, by which the heater holder 15 is positioned, is from 1 mm to 3 mm. For that reason, the above described gap can be made relatively small.

As described above, in the fixing device 10 in this embodiment, the left side end portion 15*a* of the heater holder 15 is positioned in the groove 31*a* of the frame 19*a* via the bearing 20*a*, and, therefore, positional accuracy of the heater 14 relative to the frame 19*a* is improved.

Embodiment 6

In the fixing devices 10 in the above described embodiments, with respect to the feeding direction C of the recording material S, the width of each of the grooves 31*a* and 31*b* is made greater than the width between the positioning portions 22*a* of the flange 19*a* and the width between the positioning portions 22*b* of the flange 19*b* in some cases in view of the dimensional tolerances and the thermal expansion of the components. Similarly, in some cases, the width of each of the grooves 31*a* and 31*b* is made greater than the width between the positioning portions 25*a* of the heater holder 15 and the width between the positioning portions 25*b* of the heater holder 15. In this case, with respect to the feeding direction C of the recording material S, a gap generates between the heating unit 18 and the frames 19*a* and 19*b*.

Accordingly, between the flanges 16*a* and 16*b* and the grooves 30*a* and 30*b*, and between the heater holder 15 and the grooves 30*a* and 30*b*, there are gaps with respect to the feeding direction C of the recording material S, so that an attitude of the heating unit 18 is not fixed only when the heating unit 18 is engaged with the grooves 30*a* and 30*b*.

Therefore, in the fixing device 10 in this embodiment, a constitution in which the attitude of the heating unit 18 is held by causing the heating unit 18 to contact only the downstream side groove 30*a* with respect to the feeding direction C of the recording material S was employed.

Figure 15:
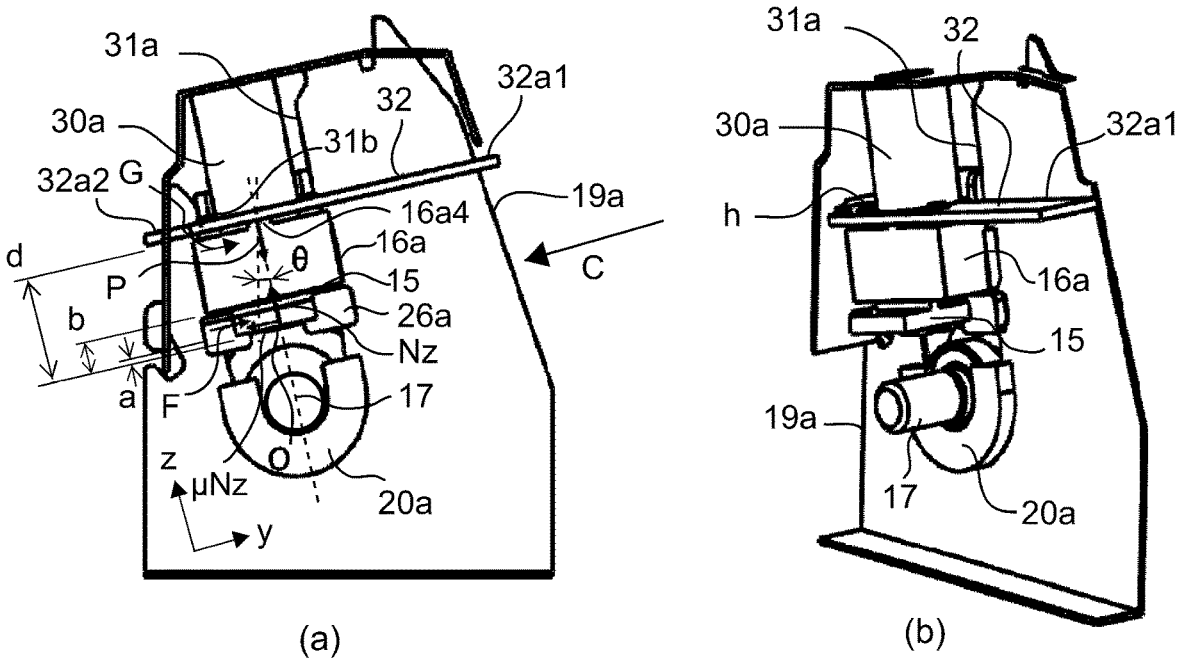
In FIG. 15, parts (a) and (b) are a left side view and a perspective view, respectively, of a fixing device in Embodiment 6.

With reference to FIG. 15, the fixing device 10 in this embodiment will be described. In FIG. 15, part (a) is a left side view of the fixing device 10 in this embodiment, and part (b) is a perspective view of the left side end portion of the fixing device 10 in this embodiment as seen from an upstream side with respect to the feeding direction C of the recording material S.

The pressing plate 32*a* functions as a lever and presses (urges) the heating unit 18 toward the pressing roller 17 along the groove 30*a* of the frame 19*a*. One end 32*a*1 of the pressing plate 32*a* is passed through a hole h provided in the frame 19*a*, and constitutes a fulcrum, and a pressing spring 30*a* is disposed and is compressed between the pressing plate 32*a* and a bent portion 35*a* of the frame 19*a*, and the other end 32*a*2 constitutes a force application point. Further, an intermediary portion of the pressing plate 32*a* constitutes a point of action at which a pressing portion 16*a*4 provided on the flange 16*a* is pressed.

As pressing springs 30*a* and 30*b*, it is also possible to apply a tension spring in place of the compression spring used in this embodiment.

By the above pressing constitution, the nip N is formed by the pressing roller 17 in cooperation with the heater 14 via the film 13. The pressing portion 16*a*4 of the flange 16*a* is an arcuately projected portion and is on a common normal (including a center of the pressing roller 17 in this embodiment) to a nip surface (plane) passing through a center of the nip N. A normal (line) is formed by shifting by a predetermined angle θ with respect to the common normal direction at the nip N, which is a press contact portion between the heating unit 18 and the pressing roller 17.

Next, the attitude of the heating unit 18 in the groove 30*a* provided with the gap, i.e., the behavior of the heating unit 18 will be described. Basically, a constitution in which, in a state in which the heating unit 18 and the pressing roller 17 are driven, depending on a force relationship between external forces acting on the heating unit 18, the heating unit 18 is locked only at a groove side edge portion 19*a*3 of the frame 19*a* in the downstream side with respect to the recording material feeding direction and thus, the attitude of the heating unit 18 is held. These external forces will be described below specifically.

In part (a) of FIG. 15, the external forces acting on the heating unit 18 are shown. In the figure, respective symbols are as follows:

P: Pressing force of the pressing plate 32*a* against the pressing portion 16*a*4 of the flange 16*a* (pressing point normal direction), Nz: Reaction from the pressing roller 17, F: Reaction received from the groove side edge portion 19*a*3 of the frame 19*a* in the downstream side with respect to the feeding direction C of the recording material S by the positioning portion 25*a* of the heater holder 15 (in the case of F<0, reaction received from the groove side edge portion 19*a*3 of the frame 19*a* in the upstream side with respect to the feeding direction C of the recording material S by the positioning portion 25*a*), G: Reaction received from the groove side edge portion 19*a*3 of the frame 19*a* in the downstream side with respect to the feeding direction C of the recording material S by the positioning portion 22*a* of the flange 16*a* (in the case of F<0, reaction received from the groove side edge portion 19*a*3 of the frame 19 in the upstream side with respect to the feeding direction C of the recording material S by the positioning portion 22*a*), μ Friction coefficient between the film 13 and the heater 14, a: Distance from the nip N to the positioning portion 25*a*, b: Distance from the nip N to the positioning portion 22*a*, d: Distance from the nip N to the pressing portion 16*a*4, and θ: Angle formed between the common normal and the groove 31*a* at the point of contact between the pressing plate 32*a* and the pressing portion 16*a*4.

The force with respect to the z direction (direction parallel to the groove), the force with respect to the y direction (direction perpendicular to the groove), and a balance expression of rotation moment around a point O (center of the nip N) are as follows:

$$\text{Force } (z \text{ direction}): P\cos\theta = Nz,$$

$$\text{Force } (y \text{ direction}): F+G=\mu Nz+P\sin\theta, \text{ and}$$

$$\text{Rotation moment around } O: aF+bG=dP\sin\theta.$$

From the above three formulas, the following two formulas are satisfied:

$$F=P\{b(\sin\theta+\mu\cos\theta)d\sin\theta\}/(b\ a), \text{ and}$$

$$G=P\{d\sin\theta a(\sin\theta+\mu\cos\theta)\}/(b\ a).$$

Here, in this embodiment, μ is obtained by actual measurement, a, b, d, θ are set to satisfy the relationship of: b(sin θ+μ cos θ)>d sin θ>a(sin θ+μ cos θ), and F>O and G>O. That is, both of the positioning portion 25*a* of the heater holder 15 and the positioning portion 22*a* of the flange 16*a* in the heating unit 18 abut against the groove side edge portion 19*a*3 of the frame 19*a* in the downstream side with respect to the feeding direction C of the recording material S.

Accordingly, the attitude of the heating unit 18 is influenced only by the dimensions of the positioning portion 25*a* of the heater holder 15, the positioning portion 22*a* of the flange 16*a*, and the groove side edge portion 19*a*3 of the frame 19, and, therefore, positional accuracy of the heater 14 is improved.

As described above, in the fixing device 10 in this embodiment, the rotation moment in a direction in which the attitude of the heater 14 is inclined acts on the heater 14 by rotation of the pressing roller 17 in the feeding direction C of the recording material S. A constitution in which, even when such rotation moment acts on the heater 14, the pressing spring 30*a* urges the flange 16*a* so as to maintain a state in which the heater holder 15 and the flange 16*a* contact the groove side edge portion 19*a*3 in the downstream side with respect to the feeding direction C of the recording material S, is employed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

We claim:

1. An image heating apparatus comprising:

(A) a frame including:

(a) a first side plate provided at one end portion; and (b) a second side plate provided at another end portion with respect to a longitudinal direction of said image heating apparatus;

(B) a cylindrical film provided between said first side plate and said second side plate and having an inside space;

(C) a heater provided in the inside space of said film;

(D) a roller forming a nip portion in cooperation with the heater through said film for nipping and feeding a recording material, wherein an image, formed on the recording material, is heated by heat of said heater, while the recording material moves in the nip portion;

(E) a holder for holding said heater, said holder being provided in the inside space of said film, and, with respect to the longitudinal direction, a length of said holder is greater than a distance between said first side plate and said second side plate, said holder including a positioning portion contacting said first side plate and positioning said holder to said first side plate with respect to the longitudinal direction; and (F) a stay for reinforcing said holder, said stay being formed of metal, provided in the inside space of said film, and having a length greater than the distance between said first side plate and said second side plate, wherein a position of said stay with respect to the longitudinal direction is determined by said holder.

2. The image heating apparatus according to claim 1, wherein said stay includes a recessed shaped groove, and said holder includes a projected shaped portion, engaged with said recessed shaped groove, for positioning said stay with respect to the longitudinal direction.

3. The image heating apparatus according to claim 2, wherein the projected shaped portion is provided at a portion, with respect to the longitudinal direction, closer to the first plate than the second plate.

4. The image heating apparatus according to claim 1, further comprising:

(G) a first preventing member, contactable to one end surface of said film when said film moves toward said first side plate, said first preventing member preventing movement of said film in the longitudinal direction, and said first preventing member engaging with said first side plate; and (H) a second preventing member, contactable to the other end surface of said film when said film moves toward said second side plate, said second preventing member preventing the movement of said film in the longitudinal direction, and said second preventing member engaging with said second side plate.

5. The image heating apparatus according to claim 1, wherein said heater includes a plate shaped substrate and a heat generating resistor formed on said substrate.

6. The image heating apparatus according to claim 5, wherein said substrate is made of a ceramic.

7. An image heating apparatus comprising:

(A) a frame including:

(a) a first side plate provided at one end portion; and (b) a second side plate provided at another end portion with respect to a longitudinal direction of said image heating apparatus;

(B) a cylindrical film provided between said first side plate and said second side plate and having an inside space;

(C) a nip forming unit provided in the inside space of said film and contacting an inner surface of said film, said nip forming unit including:

(a) a heater;

(b) a holder for holding said heater, said holder including a positioning portion contacting said first side plate and positioning said holder to said first side plate with respect to the longitudinal direction, wherein, with respect to the longitudinal direction, a length of said holder is greater than a distance between said first side plate and said second side plate; and (c) a stay made of metal for reinforcing said holder, wherein, with respect to the longitudinal direction, a length of said stay is greater than the distance between said first side plate and said second side plate, and wherein a position of said stay with respect to the longitudinal direction is determined by said holder; and (D) a roller forming a nip portion in cooperation with said nip forming unit through said film for nipping and feeding a recording material, wherein an image, formed on the recording material, is heated by heat of said heater, while the recording material moves in the nip portion.

8. The image heating apparatus according to claim 7, wherein said stay includes a recessed shaped groove, and said holder includes a projected shaped portion, engaged with said recessed shaped groove, for positioning said stay with respect to the longitudinal direction.

9. The image heating apparatus according to claim 8, wherein the projected shaped portion is provided at a portion, with respect to the longitudinal direction, closer to the first plate than the second plate.

10. The image heating apparatus according to claim 7, further comprising:

(G) a first preventing member, contactable to one end surface of said film when said film moves toward said first side plate, said first preventing member preventing movement of said film in the longitudinal direction, and said first preventing member engaging with said first side plate; and (H) a second preventing member, contactable to the other end surface of said film when said film moves toward said second side plate, said second preventing member preventing the movement of said film in the longitudinal direction, and said second preventing member engaging with said second side plate.

11. The image heating apparatus according to claim 7, wherein said heater includes a plate shaped substrate and a heat generating resistor formed on said substrate.

12. The image heating apparatus according to claim 11, wherein said substrate is made of a ceramic.

* * * * *